US010267343B2

(12) United States Patent
Veit et al.

(10) Patent No.: US 10,267,343 B2
(45) Date of Patent: Apr. 23, 2019

(54) CONTROL SYSTEM FOR A HYDRAULIC WORK MACHINE

(71) Applicant: Putzmeister Engineering GmbH, Aichtal (DE)

(72) Inventors: Jan-Martin Veit, Reutlingen (DE); Wolf-Michael Petzold, Aichwald (DE)

(73) Assignee: Putzmeister Engineering GmbH, Aichtal (DE)

( * ) Notice: Subject to any disclaimer, the term of this patent is extended or adjusted under 35 U.S.C. 154(b) by 197 days.

(21) Appl. No.: 15/299,180

(22) Filed: Oct. 20, 2016

(65) Prior Publication Data

US 2017/0037882 A1 Feb. 9, 2017

Related U.S. Application Data

(63) Continuation of application No. PCT/EP2015/058852, filed on Apr. 23, 2015.

(30) Foreign Application Priority Data

Apr. 23, 2014 (DE) ..... 10 2014 207 669

(51) Int. Cl.
*F15B 20/00* (2006.01)
*B66C 13/20* (2006.01)
(Continued)

(52) U.S. Cl.
CPC ..... *F15B 20/00* (2013.01); *B66C 13/20* (2013.01); *E02F 9/226* (2013.01); *E02F 9/2267* (2013.01); *E02F 9/2292* (2013.01); *E02F 9/2296* (2013.01); *E04G 21/04* (2013.01); *F04B 15/02* (2013.01); *F04B 17/06* (2013.01); *F04B 49/06* (2013.01); *F15B 11/16* (2013.01);
(Continued)

(58) Field of Classification Search
CPC ..... F15B 20/00; F15B 2211/5157
See application file for complete search history.

(56) References Cited

U.S. PATENT DOCUMENTS 3,815,478 A 6/1974 Axelsson et al.
5,421,705 A 6/1995 Benckert
(Continued)

FOREIGN PATENT DOCUMENTS

CN 202883521 U 4/2013
DE 41 15 606 A1 11/1992
(Continued)

OTHER PUBLICATIONS

English translation of the International Preliminary Report on Patentability, PCT/EP2015/058852, dated Aug. 8, 2016.

*Primary Examiner* — F Daniel Lopez
(74) *Attorney, Agent, or Firm* — Bose McKinney & Evans LLP

(57) ABSTRACT

Disclosed is a control system for a hydraulic work machine, comprising a plurality of hydraulic work circuits for supplying actuators and/or drive units of movable machine parts with hydraulic fluid, and an emergency stop circuit for the work circuits for avoiding danger caused by the machine parts. According to this disclosure, the emergency stop circuit comprises a single safety valve which is connected in parallel to the work circuits via at least one branch line each at the inlet and to a pressure relief point at the outlet.

15 Claims, 2 Drawing Sheets

(51) Int. Cl.

| | |
|---|---|
| ***E02F 9/22*** | (2006.01) |
| ***E04G 21/04*** | (2006.01) |
| ***F04B 15/02*** | (2006.01) |
| ***F04B 17/06*** | (2006.01) |
| ***F04B 49/06*** | (2006.01) |
| ***F15B 11/16*** | (2006.01) |
| ***F15B 13/06*** | (2006.01) |

(52) U.S. Cl.
CPC ..... *F15B 13/06* (2013.01); *F15B 2211/20546* (2013.01); *F15B 2211/20576* (2013.01); *F15B 2211/625* (2013.01); *F15B 2211/7142* (2013.01); *F15B 2211/8755* (2013.01)

(56) References Cited

U.S. PATENT DOCUMENTS

| | | | | |
|---|---|---|---|---|
| 6,171,075 | B1 | 1/2001 | Münzenmaier et al. | |
| 6,314,997 | B1 | 11/2001 | Yamashita | |
| 2005/0098030 | A1 | 5/2005 | Rollmann | |
| 2012/0152642 | A1 | 6/2012 | Takahashi et al. | |
| 2015/0226240 | A1* | 8/2015 | Kropp ..... | F15B 20/00 91/1 |

FOREIGN PATENT DOCUMENTS

| | | | |
|---|---|---|---|
| DE | 10 2006 054 122 | A1 | 5/2008 |
| EP | 1 577 563 | A2 | 9/2005 |
| WO | WO 97/18395 | A1 | 5/1997 |
| WO | WO 02/061288 | A2 | 8/2002 |

* cited by examiner

CONTROL SYSTEM FOR A HYDRAULIC WORK MACHINE

RELATED APPLICATIONS

This application is a continuation of PCT/EP2015/058852, filed Apr. 23, 2015, which claims priority to DE 10 2014 207 669.2, filed Apr. 23, 2014, both of which are hereby incorporated herein by reference in their entireties.

BACKGROUND

The invention relates to a control system for a hydraulic work machine, in particular for a movable or stationary thick matter pump, a truck mixer, an excavator or a mobile crane, having a plurality of hydraulic operating circuits which can preferably be controlled by means of a central control unit and which are configured in order to supply pressure oil to actuation members and/or drive units of movable machine components, and having an emergency stop circuitry for the operating circuits which can be activated to stop a machine movement in order to prevent danger resulting from the machine components. The invention further relates to a hydraulic work machine having such a control system.

Automatic concrete pumps contain a large number of hydraulically movable machine components, in particular the mast arms of the concrete distribution mast which are connected to each other by means of articulated axles in order to prepare the concrete which is required at the building site and to convey it to the processing location. Uncontrolled disruptions in complex systems of this type could lead to serious damage in the operating environment or to the machine. Therefore, there is required a safety or emergency stop circuitry which, where applicable, enables intervention safely in the functional sequence and enables undesirable consequences of failures and damage to be avoided.

SUMMARY

Based on the above discussion, this disclosure further improves the control systems known in the prior art and using the simplest means possible achieves a reliable emergency stop function which stops machine movements in a plurality of hydraulic operating circuits which are operated at the same time.

This disclosure is based on the notion of connecting all the hydraulic operating circuits via a common safety valve in a pressure-free state and consequently stopping the movements of machine components by switching off the hydraulic drive energy. Accordingly, it is proposed according to this disclosure that the emergency stop circuitry have a single safety valve which is connected in parallel at the inlet thereof to the operating circuits or the pressure oil branches thereof by means of at least one branch line each and which is connected at the outlet side to a pressure relief point. Consequently, it is possible to shut down actuation members or drive units of consumers with little switching complexity without each individual actuation member/consumer having to be considered separately. Consequently, dangerous movements of large machine components, such as mast arms, can also be stopped with a short reaction time. Such an emergency stop also interrupts machine movements in the event of an emergency, in contrast to an emergency operation which is not relevant in this instance and in which such movements are still possible where applicable with reduced drive energy or auxiliary energy.

Advantageously, the safety valve can be switched as a directional valve between a blocking position which is assumed during normal operation and a throughflow position which transmits the emergency stop function and which is preferably resiliently centered as a rest position. Consequently, even in the event of a failure of the (electrical) control, an independent assumption of the safe position is ensured.

In order to afford an operator a possibility of intervention, it is advantageous for the safety valve to be able to be actuated manually by means of an emergency stop button. In parallel, it is also possible to implement in the central control unit an automatic safety shutdown, or to activate the valve by means of a suitable safety module.

Advantageously, the safety valve can be actuated as an electrohydraulic directional valve by means of an electrical control line. This is preferably carried out in such a manner that the emergency stop is ensured even in the event of a power failure.

Depending on the drive in the open or closed operating circuit, it is advantageous for the pressure relief point to be formed by means of a tank or a suction return filter of a pressure oil source.

In order to prevent a short-circuit between the different consumers, it is advantageous for a non-return valve which is permeable in the direction of the safety valve to be arranged in each branch line.

Another structural simplification can be achieved by the non-return valves being arranged in a common valve block.

An advantageous intervention possibility, in particular for thick matter pumps, is produced by at least one actuation member being formed by means of an actuation cylinder which acts on a variable displacement pump. In order to switch both adjustment chambers at the same time to the same pressure, it is advantageous for the actuation cylinder to be connected to the inlet of the safety valve by means of a branch line at each of the two sides thereof (in particular at the base and rod side in a differential cylinder).

As long as at least one drive unit is acted on with pressure oil in an open drive circuit by means of a pump, it may also be advantageous for the branch line to branch between the pump and drive unit in the main oil flow of the pump or alternatively at a pump controller.

In order to further comply with the safety requirements, it is advantageous for the safety valve to be provided with a position monitoring system.

For particularly advantageous use, there is provision for the operating circuit to be configured to operate at least one element from the group thick matter pump, distributor mast, stirrer, hydraulic accumulator, support leg.

In order to carry out control or drive functions, the hydraulic operating circuits each contain a hydraulic pressure source for supplying pressure oil to the actuation members and/or drive units of movable machine components. In this instance, there is provision for the branch lines to each lead from a pressure side of the hydraulic pressure source or a pressure oil branch of the operating circuits to the inlet of the safety valve.

The subject-matter of this disclosure is also a hydraulic work machine having a control system according to this disclosure.

BRIEF DESCRIPTION OF THE DRAWINGS

The above-mentioned aspects of exemplary embodiments will become more apparent and will be better understood by reference to the following description of the embodiments taken in conjunction with the accompanying drawings, wherein.

DESCRIPTION

Figure 1:
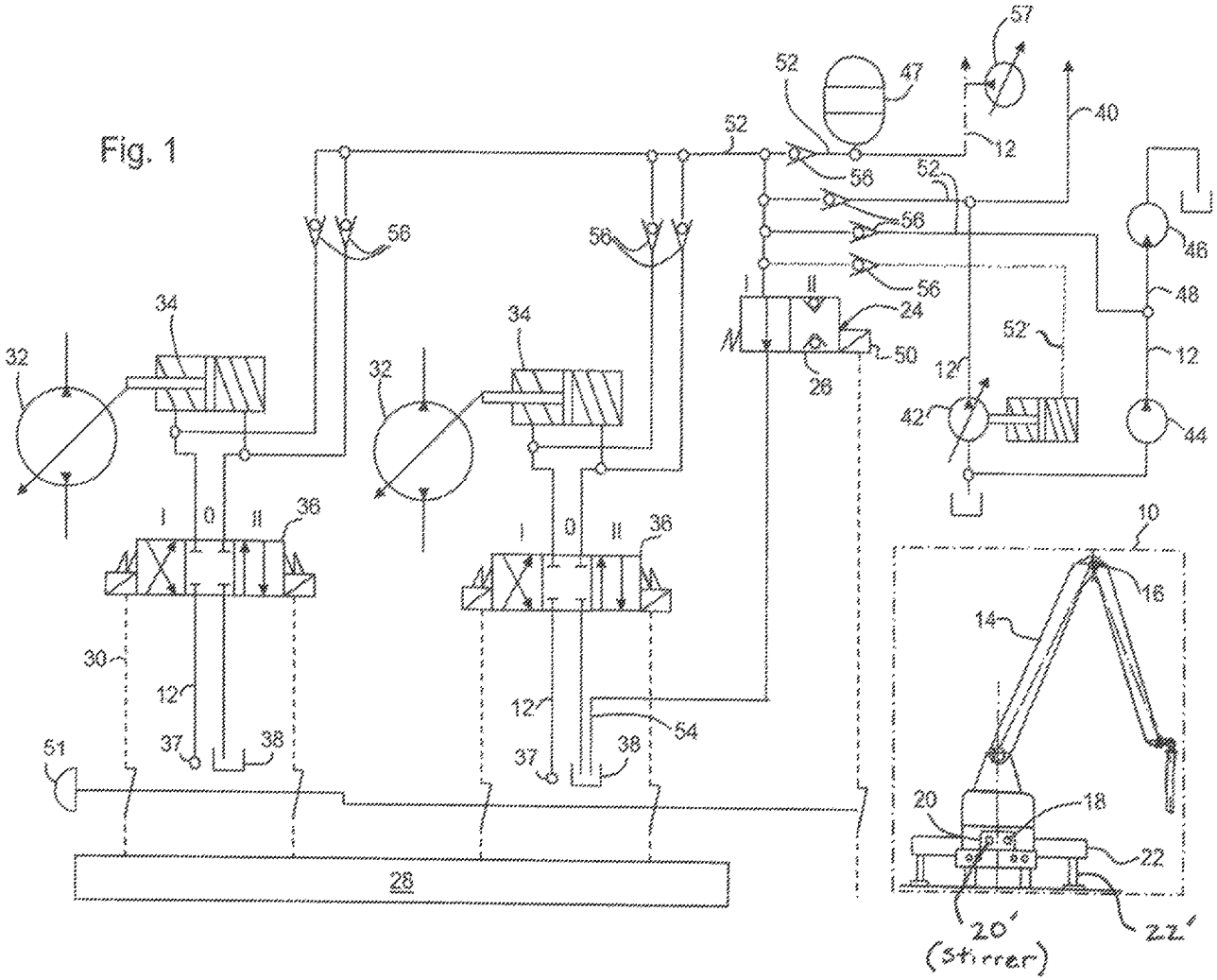
FIG. 1 shows a hydraulic circuit diagram of a control system for a truck-mounted concrete pump with an emergency stop circuitry.

The embodiments described below are not intended to be exhaustive or to limit the invention to the precise forms disclosed in the following description. Rather, the embodiments are chosen and described so that others skilled in the art may appreciate and understand the principles and practices of this disclosure.

The truck-mounted concrete pump 10 which is indicated only schematically in the circuit diagram comprises as a hydraulic work machine a plurality of movable machine components which are driven by means of hydraulic operating circuits 12, in particular a concrete distributor mast 14 with hydraulically actuatable articulated joints 16, a two-cylinder concrete pump 18 with hydraulically driven conveyor pistons and pipe diverter, a concrete feed container 20 which is arranged upstream of the pump 18 and which has a hydraulic stirrer 20' and support arms 22 which can be laterally deployed and which have support legs 2T which can be hydraulically extended. In the event of an emergency, in order to enable a stoppage or shutdown of all hydraulically produced movements—in particular those involving danger—by means of the simplest control construction possible, there is provided an emergency stop circuitry 24 which comprises a single electrohydraulic safety valve 26.

All the hydraulic operating circuits 12 can be controlled by means of a central control unit 28. In this instance, electric lines 30 enable an electric valve reversal.

In order to supply pressure oil to the hydraulic drive of the concrete pump 18, there are provided two hydraulic reversing pumps 32 which are constructed as swash plate axial piston pumps and whose swash plate angle can be adjusted by means of actuation cylinders 34. The actuation cylinders 34 can be actuated in each case by means of an associated control valve 36 in accordance with the desired conveying quantity. In the switching position I, a base-side action of pressure and, in the switching position II, a rod-side action of pressure on the actuation cylinders 34 by means of a respective operating circuit 12 is enabled. This leads in this instance from a hydraulic pressure source 37 (hydraulic pump) to the tank 38 and contains the control valve 36 and the actuation cylinder 34. Further details of such a pump control system can also be derived from WO 97/18395 to which reference is made in this context.

The supply of pressure oil to the distributor mast 14 is carried out in an additional open operating circuit 12, 40 in which a variable displacement pump 42 provides as a pressure source a considerably smaller quantity of oil in comparison with the hydraulic reversing pumps 32. An additional pump 44 supplies the motor 46 of the stirrer in the concrete feed container 20 with hydraulic drive energy via the operating circuit 12, 48. Furthermore, a hydraulic accumulator 47 is provided as a pressure source which can be loaded by a variable displacement pump 57 in order to support the switching of the pipe diverter of a two-cylinder concrete pump 18.

The safety valve 26 can be switched as a 2/2 directional valve between a passage position I which transmits the emergency stop function and a blocking position II. The blocking position II is electrically controlled during normal operation by means of an actuation element 50 (by means of the control unit 28 or/and a separate emergency stop monitoring unit), whilst the passage position I is resiliently centered in a powerless state as a rest position. A manual activation of the actuation element 50 is possible via an emergency off switch 51. In this instance, a position monitoring of the safety valve 26 should also be configured in order to comply with the requirements of DIN EN ISO 13849.

Figure 3:
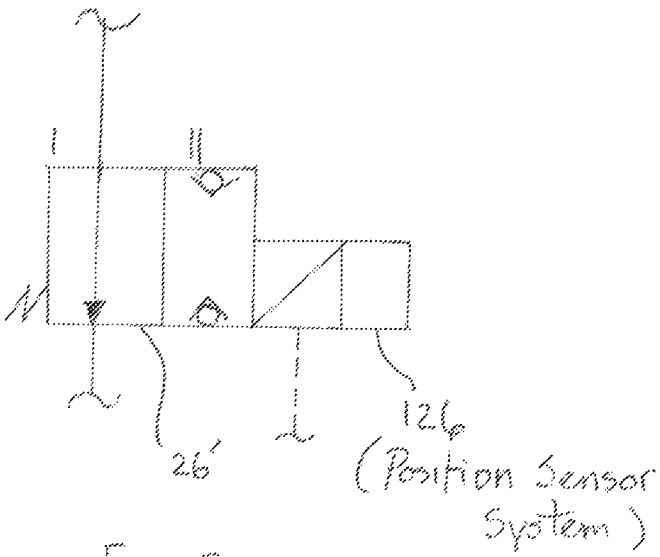
FIG. 3 schematically shows safety valve with a position monitoring system.

FIG. 3 schematically depicts an embodiment wherein safety valve 26' includes a position monitoring system 126.

Figure 2:
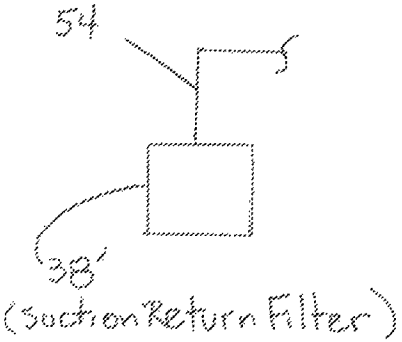
FIG. 2 schematically shows a suction return filter.

In order to bring about the emergency stop via a pressure relief of all the hydraulic operating circuits 12, they are connected to the inlet of the safety valve 26 parallel with each other by means of at least one branch line 52 each. The outlet thereof leads to a pressure relief point 54 which in the example shown is formed by means of a tank 38. During driving in a closed circuit, pressure relief at a suction return filter is also conceivable. FIG. 2 schematically depicts an embodiment wherein the pressure relief point 54 takes the form of a suction return filter 38'.

The safety valve 26 is of a sufficient size so that even with the maximum quantity of oil and the lowest permissible operating temperature, the dynamic pressure is sufficiently low to be able to maintain the pressure relief.

In order to prevent a short-circuit between the individual consumers, non-return valves 56 are arranged in the branch lines 52. These may either be arranged in a common valve block or in a decentralized manner.

As a result of the large delivery quantity of the hydraulic reversing pumps 32, they are not intended to have the pressure relieved directly via the safety valve 26. Instead, the actuation cylinders 34 are switched to the same pressure at the rod side and base side by means of a branch path so that the swash plate angle of the reversing pumps is adjusted to "zero conveying quantity." At the necessary minimum pressure, a throttle may be provided.

When driving in an open circuit, in an emergency stop situation a main oil flow may be diverted directly via the electrohydraulic safety valve 26, as shown for the variable displacement pump 42. Alternatively, the pump controller thereof may also have the pressure relieved by means of the branch line 52'.

While exemplary embodiments have been disclosed hereinabove, the present invention is not limited to the disclosed embodiments. Instead, this application is intended to cover any variations, uses, or adaptations of this disclosure using its general principles. Further, this application is intended to cover such departures from the present disclosure as come within known or customary practice in the art to which this invention pertains and which fall within the limits of the appended claims.

What is claimed is:

1. A control system for a hydraulic work machine, comprising:

a plurality of hydraulic operating circuits that are controllable to supply pressure oil to hydraulic devices of movable machine components;

emergency stop circuitry for the operating circuits which can be activated to stop a machine movement to prevent danger resulting from the machine components;

each hydraulic operating circuit containing a respective hydraulic pressure source configured to supply pressure oil to a respective one or more of the hydraulic devices;

the emergency stop circuitry having a single safety valve, an inlet of the single safety valve being connected in parallel to each operating circuit by a respective branch line, an outlet of the single safety valve being connected to a pressure relief point; and wherein the safety valve can be switched between a blocking position and a throughflow position, the safety valve being in the blocking position during normal operation and in the throughflow position during an emergency stop event and wherein the safety valve is resiliently biased toward the throughflow position.

2. The control system as claimed in claim 1, wherein a manually actuable emergency stop button is operable to actuate the safety valve.

3. The control system as claimed in claim 1, wherein the safety valve is actuable by an electrical control line.

4. The control system as claimed in claim 1, wherein the pressure relief point comprises a tank or a suction return filter.

5. The control system as claimed in claim 1, further comprising a non-return valve arranged in each branch line, each non-return valve permitting flow in a direction toward the safety valve.

6. The control system as claimed in claim 5, wherein the non-return valves are arranged in a common valve block.

7. The control system as claimed in claim 1, wherein one of the hydraulic devices of one of the hydraulic operating circuits includes an actuation cylinder which acts on a variable displacement pump.

8. The control system as claimed in claim 7, wherein the actuation cylinder is connected to the inlet of the safety valve by a respective branch line at the base side and rod side of the actuation cylinder.

9. The control system as claimed in claim 1, wherein the pressure source of one of the hydraulic operating circuits includes a pump which is connected to one of the hydraulic devices by an open drive circuit, wherein a respective one of the branch lines branches from the open drive circuit.

10. The control system as claimed in claim 1, wherein one of the operating circuits is configured to operate at least one of the following: a thick matter pump, a distributor mast, a stirrer, a hydraulic accumulator, or a support leg.

11. The control system as claimed in claim 1, wherein each branch line leads from a pressure side of the respective pressure source to the inlet of the safety valve.

12. A hydraulic work machine, comprising a control system as claimed in claim 1 wherein the hydraulic work machine is a thick matter pump, a truck-mounted mixer, an excavator or a mobile crane.

13. A control system for a hydraulic work machine, comprising:

a plurality of hydraulic operating circuits that are controllable to supply pressure oil to hydraulic devices of movable machine components;

emergency stop circuitry for the operating circuits which can be activated to stop a machine movement to prevent danger resulting from the machine components;

each hydraulic operating circuit containing a respective hydraulic pressure source configured to supply pressure oil to a respective one or more of the hydraulic devices;

the emergency stop circuitry having a single safety valve, an inlet of the single safety valve being connected in parallel to each operating circuit by a respective branch line, an outlet of the single safety valve being connected to a pressure relief point; and wherein the safety valve includes a position monitoring system.

14. The control system as claimed in claim 13, wherein the safety valve can be switched between a blocking position and a throughflow position, the safety valve being in the blocking position during normal operation and in the throughflow position during an emergency stop event.

15. The control system as claimed in claim 14, wherein in the safety valve is resiliently biased toward the throughflow position.

* * * * *